United States Patent [19]

Tanaka

[11] Patent Number: 4,784,620

[45] Date of Patent: Nov. 15, 1988

[54] ELECTRICAL CONTACT PIN

[75] Inventor: Yoshihito Tanaka, Tokyo, Japan

[73] Assignee: Hirose Electric Co., Ltd., Tokyo, Japan

[21] Appl. No.: 138,077

[22] Filed: Dec. 28, 1987

Related U.S. Application Data

[63] Continuation of Ser. No. 865,458, May 21, 1986, abandoned.

[30] Foreign Application Priority Data

Jul. 2, 1985 [JP] Japan ..... 60-144946

[51] Int. Cl.[4] ..... H01R 13/428

[52] U.S. Cl. ..... 439/751; 439/82

[58] Field of Search ..... 439/82, 84, 743, 751, 439/825, 827, 869, 870, 873

[56] References Cited

U.S. PATENT DOCUMENTS 3,827,004 7/1974 Vanden Hennel et al. ..... 439/873
3,862,792 1/1975 Jayne ..... 439/733
4,223,970 9/1980 Walter ..... 439/82
4,733,465 3/1988 Tanaka ..... 439/82

FOREIGN PATENT DOCUMENTS 0084318 7/1983 European Pat. Off. .
58-123678 7/1983 Japan .

*Primary Examiner*—Gary F. Paumen
*Attorney, Agent, or Firm*—Takeuchi Patent Office

[57] ABSTRACT

An electrical contact pin has a mounting portion to be fitted into a PTH of a circuit board for fixing without using any solder. The mounting portion has a substantially rectangular cross section. A pair of alternating recesses are provided on opposite sides of said rectangular section. A pair of corners adjacent to said recesses extend beyond said sides to form a pair of resilient projected sharp corners. Because of the resilient projected sharp corners, the contact pin fits into a PTH of large tolerances.

3 Claims, 2 Drawing Sheets

ELECTRICAL CONTACT PIN

CROSS-REFERENCES TO RELATED APPLICATIONS

This application is a continuation of Ser. No. 865,458 filed on May 21, 1986, now abandoned.

BACKGROUND OF THE INVENTION

The present invention relates to an electrical contact pin having a mounting portion to be fitted into a plated through hole (PTH) of a circuit board without using any solder.

Electrical contact pins of such a type are sometimes called "press fit contactors" and disclosed in for example in U.S. Pat. Nos. 4,223,970 issued to Leo Walter on Sept. 23, 1980, and 4,464,009 to Hartmuth Thaler on Aug. 7, 1984, and Japanese Pat. Kokai No. 58-123,678.

Walter Patent discloses a compliant backplane electrical connector having a pin with four edges at the corners of the generally rectangular, Z-shaped cross section of the pin. Such edges penetrate the plating of an opening upon insertion of the pin into the opening.

The Thaler Patent discloses a solderless connector pin for electrical circuits. It has an elongated deformable region having an M-shaped or W-shaped cross section. Upon insertion of the pin into a bore, the deformable region deforms elastically and, in the case of a small diameter bore, partially plastically to provide a good electrical and mechanical connection between the pin and the plating.

Japanese Pat. No. 58-123,678 discloses, as shown in FIG. 6(D), a contact pin consisting of a mounting portion 1 having an N-shaped cross section with a pair of triangular recesses 2 and 3 arranged in an alternating fashion on opposite sides. In order that corners 4 and 5 adjacent to these triangular recesses fully abut the conductive through hole of a circuit board, the opposite corners of the terminal are rounded to form chamfers 6 and 7. The mounting portion 1 of contact pin 9 with such structure has a springy accordion-like property.

One method of manufacturing such contact pins with the aid of a press machine will be described.

(1) As FIG. 6(A) shows, upper and lower metal dies 20 and 30 have triangular projections 21 and 31 to form the triangular recesses 2 and 3 and rounded corners 22 and 32 to form chamfers 6 and 7, respectively, of a metallic work or mounting portion 1.

(2) These dies are mounted on a press machine and pressed against the metal work 1 in the vertical direction. As FIG. 6(B) shows, as a result, indefinite burrs or fins 2' and 3' of excess material are produced because of the presence of triangular projections 21 and 31 and rounded corners 22 and 32.

(3) As FIG. 6(C) shows, these undesired burrs or fins 2' and 3' of excess material are cut off by a pair of press cutters 22 and 33.

(4) As FIG. 6(D) shows, finally, a mounting portion having an N-shaped cross section is completed.

Electrical contact pins having such a springy accordion-like mounting portion as described above have been developed so as to fit into PTHs in a certain range of diameters of a circuit board. However, they still have the following disadvantages:

(1) Where the diameter of a PTH is relatively large, although the corners 4 and 5 adjacent to the triangular recesses can abut the conductive wall of a PTH making electrical connection, the other rounded corners or chambers 6 and 7 cannot abut the conductive wall, because the diameter between the rounded corners 6 and 7, which is smaller than that between the corners 4 and 5, is smaller than the relatively large PTH diameter, thus as a whole making poor connection and increasing contact resistance especially after a vibration or shock has been applied for a long period of time.

(2) Where the diameter of a PTH is relatively small, the non-springy chamfers 6 and 7 strongly abut the conductive wall (solder layer) and severely damage it, thus increasing contact resistance or making conduction impossible because of complete separation of the conductive wall from the PTH.

(3) The indefinite burrs or fins 2' and 3' formed in the pressing step are so small that it is a difficult operation to cut them off. In addition, the resulting cuts become broken surfaces **6*b* and 7*b* as shown in FIG. 6(D) making the corners 4 and 5** imperfect or too short to penetrate the conductive wall of a PTH or reducing the accordion-like spring force of the corners.

SUMMARY OF THE INVENTION

Accordingly, it is an object of the invention to provide an electrical contact pin having a mounting portion to always be fitted into a PTH regardless of a considerable amount of its variations or tolerances, thus always making good electrical and mechanical connection.

In accordance with the invention there is provided an electrical contact pin having a mounting portion to be fitted into a PTH of a circuit board for fixing without using any solder, characterized in that the mounting portion has a substantially rectangular cross section, at least a pair of alternating recesses are provided on opposite sides of said rectangular section, and that a pair of corners adjacent to said recesses extend beyond said sides to form a pair of resilient projected sharp corners.

Because of these resilient projected sharp corners and rigid diagonal sharp corners, the contact pin of the invention is able to fit into a PTH in a wide range of tolerances.

Other objects, features and advantages of the invention will be apparent from the following description when taken in conjunction with the accompanying drawings.

DESCRIPTION OF THE PREFERRED EMBODIMENTS

Figure 1:
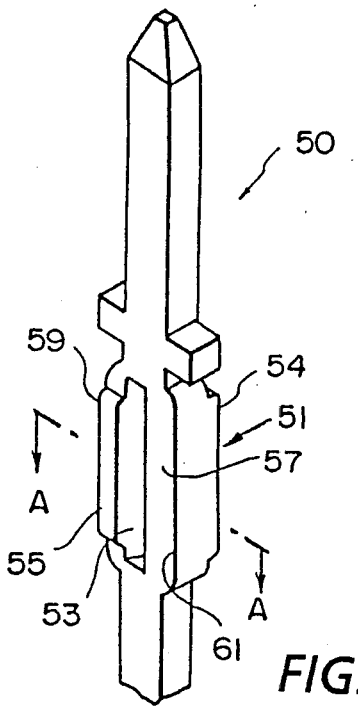
FIG. 1 is a perspective view of an electrical contact pin according to an embodiment of the present invention.
Figure 2:
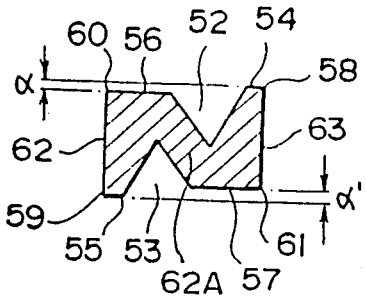
FIG. 2 is a sectional view taken along the line A—A of FIG. 1.

As FIGS. 1 and 2 show, an electrical contact pin 50 according to an embodiment of the invention has in its middle portion a mounting portion 51 to be fitted into a PTH of a circuit board. This mounting portion has a pair of triangular recesses 52 and 53 arranged in alternating form. A pair of projections 54 and 55 extending by $\alpha$ and $\alpha'$ from opposite surfaces 56 and 57 are formed at diagonally opposing corners adjacent to the triangular recesses 52 and 53. The outside corners of projections 54 and 55 and the other diagonally opposing corners have sharp corners or edges 58, 59, 60 and 61 respectively. These corners are made not necessarily at right angles but must be sufficiently sharp to penetrate the conductive wall of a PTH. They may be rounded corners or chamfers. There is a slanted intermediate portion 62A between the triangular recesses 52 and 53.

Figure 3A:
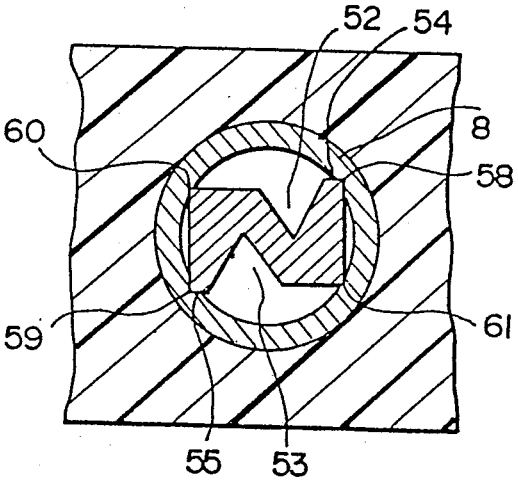
FIGS. 3A and 3B are sectional views of the electrical contact pin of FIG. 1 that is fitted into relatively large and small PTHs, respectively.
Figure 3B:
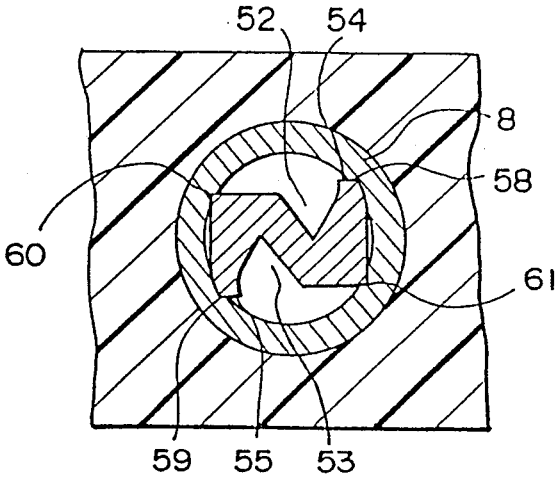

The electrical contact pin 50 of such a structure is capable of fitting into PTHs of somewhat different diameters of a circuit board. FIGS. 3A and 3B show in section the contact pins 50 fitted into PTHs 8 of relatively large and small inside diameters, respectively.

In FIG. 3A, the outer corners 58 and 59 of projections 54 and 55 penetrate the conductive wall of a relatively large PTH 8 and the other diagonal corners 60 and 61 also penetrate the conductive wall although the amount of the penetration is less than that of the projected outer corners 58 and 59. In a sufficiently large hole, only the corners 58 and 59 would contact the wall.

In FIG. 3B, as the contact pin is fitted into a PTH of a relatively small diameter, the springy projections 54 and 55 are bent inward while the projection corners 58 and 59 penetrate the conductive wall. In this case, the other corners 60 and 61 penetrate the conductive wall more than in the case of the above relatively large hole. Thus, the contact pin according to the invention can always penetrate the conductive wall of a certain PTH at four points, regardless of its diameter variations, eliminating the occurrence of poor contact when a vibration or shock is applied for a long period of time.

Figure 4A:
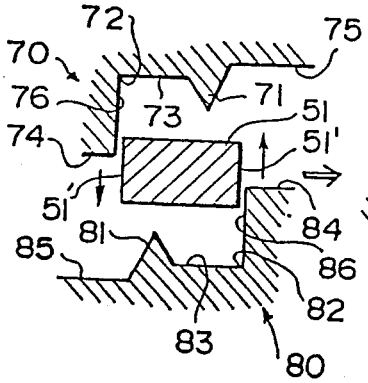
FIGS. 4A–4C illustrate how to make the electrical contact pin of FIG. 1.
Figure 4B:
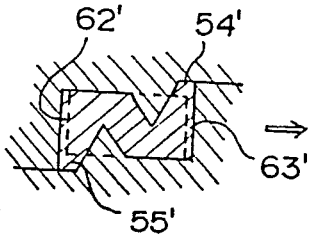
Figure 4C:
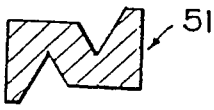

FIGS. 4A–4C illustrate a method of manufacturing a contact pin 50 having such a mounting portion 51 as described above. As FIG. 4A shows, a pin element having a mounting portion 51 with a rectangular section, which has been stamped out of a sheet of metal, is placed between the upper and lower dies 70 and 80. The upper die 70 has a triangular projection 71 to form the triangular recess 52 of mounting portion 51, a bottom surface 73 to form the surface 56, a corner 72 to form the corner 60, a left-hand projection surface 74 to abut the left-hand bottom surface 85 of lower die 80 when both dies are pressed, and a right-hand bottom surface 75 that is made higher than the bottome surface 73. Similarly, the lower die 80 has a triangular projection 81, a bottom surface 83, and a corner 82 to form the triangular recess 53, surface 57, and corner 61, respectively, and a right-hand projection surface 84 to abut the right-hand bottom surface 75 of upper die 70 when both dies are pressed, and a left-hand bottom surface 85 that is made lower than the bottom surface 83.

As FIG. 4B shows, the upper and lower die 70 and 80 are pressed by a press machine to squeeze the metal work 51 to form a mounting portion having an N-shaped cross section. There are small spaces 54' and 55' between the mold cavity and the metal work before pressing as shown in dotted line. The triangular projections 71 and 81 of upper and lower dies 70 and 80 push metal from the recesses 52 and 53 into these spaces 54' and 55' to form projections 54 and 55 with sharp corners 58 and 59. There are also narrow spaces 62' and 63' between the side walls 76 and 86 of upper and lower dies 70 and 80 and the opposite sides 51' of metal work 51 before pressed. The opposite sides 62 and 63 of N-shaped mounting portion 51 can expand upon pressing into these spaces and produce no burrs of excess material, making the pressing operation easier than prior art.

FIG. 4C shows in section the finished mounting portion 51 that is identical with that of FIG. 2.

Figure 5A:
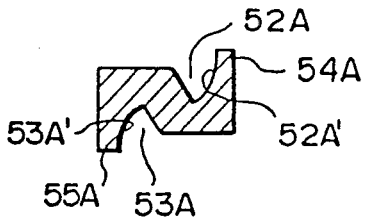
FIGS. 5A–5C are sectional views of mounting portions according to other embodiments of the present invention.
Figure 5B:
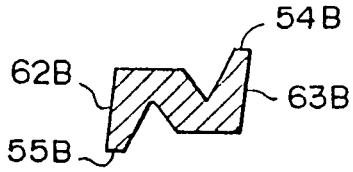
Figure 5C:
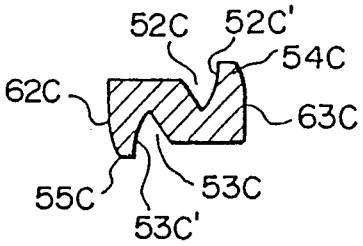
Figure 6A:
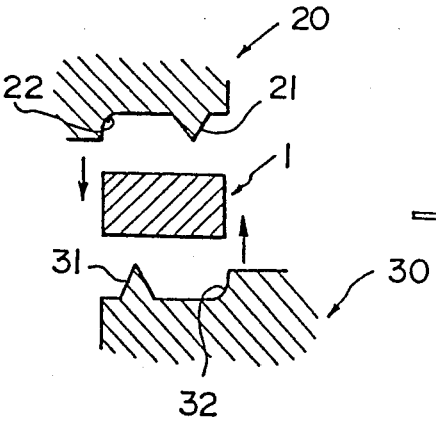
FIG. 6 A PRIOR ART
FIGS. 6A–6D illustrate a method of making a conventional electrical contact pin.
Figure 6B:
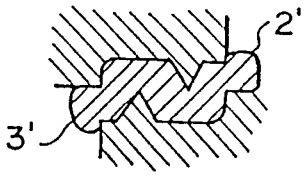
FIG. 6 B PRIOR ART
Figure 6C:
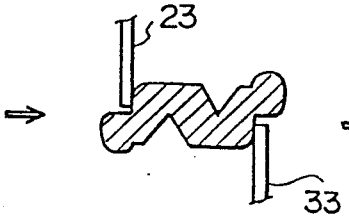
FIG. 6 C PRIOR ART
Figure 6D:
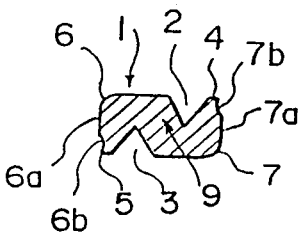
FIG. 6 D PRIOR ART

FIGS. 5A–5C illustrate other embodiments of the present invention. In FIG. 5A, the outer sides 52A' and 53A' of recesses 52A and 53A are curved or concave to give more spring property to the projections 54A and 55A, respectively.

In FIG. 5B, the left side 62B and right side 63B of projections 55B and 54B are inclined with the tip outward so that the pressing operation may be easier than prior art.

In FIG. 5C, both sides 52C' and 53C' of recesses 52C and 53C and the tips of left and right sides 62C and 63C are curved so that the contact pin may fit into a smaller PTH at a larger contact area with the conductive layer of the PTH.

According to the invention there are provided the following advantages:

(1) Where the inside diameter of a PTH is relatively large, the four corners of a contact pin penetrate the conductive wall of the PTH so firmly that there is little or no danger of causing poor contact or increased contact resistance even if it is subjected to a long period of vibrations or shocks.

(2) When the inside diameter of a PTH is relatively small, the projections of the mounting portion are resiliently bent inward while penetrating the conductive wall and the other corners firmly penetrate the conductive wall so that there is little or no possibility of damaging the conductive wall or increasing the contact resistance or separating the conductive wall from the PTH.

(3) There are neither burrs nor fins of excess metal caused by the pressing operation so that the N-shaped mounting portion, which is easy to penetrate the conductive wall of a PTH, may be formed by only a single pressing operation, thus providing an inexpensive but reliable contact pin.

Although the preferred embodiments of the present invention have been described above, other embodiments and modifications which would be apparent to one having ordinary skill in the art are intended to be covered by the spirit and scope of the appended claims.

What is claimed is:

1. An electrical contact pin comprising:

a mounting portion to be fitted into a plated through hole of a circuit board and fixed therein without using any solder;

said mounting portion having a generally rectangular cross section with a top, a bottom, a pair of sides, and four sharp corners;

a pair of substantially triangular recesses provided on said top and bottom of said rectangular section in an alternating fashion to form a substantially N-shaped cross section; and a pair of said sharp corners adjacent to said triangular recesses extending beyond said top and bottom to form a pair of resilient projected sharp corners.

2. The electrical contact pin of claim 1, wherein a side of each said triangular recess adjacent to its respective said projected corner is made concave to give more resiliency to said corner.

3. The electrical contact pin of claim 1, wherein said sides of said rectangular section are inclined with said resilient projected sharp corners extending outwardly so as to facilitate pressing of said mounting portion into said plated through hole.

* * * * *